US008643576B2

(12) United States Patent
Ishiguro et al.

(10) Patent No.: US 8,643,576 B2
(45) Date of Patent: Feb. 4, 2014

(54) PIXEL CIRCUIT DRIVING METHOD, LIGHT EMITTING DEVICE, AND ELECTRONIC APPARATUS

(75) Inventors: Hideto Ishiguro, Shiojiri (JP); Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1070 days.

(21) Appl. No.: 12/534,524

(22) Filed: Aug. 3, 2009

(65) Prior Publication Data

US 2010/0053141 A1 Mar. 4, 2010

(30) Foreign Application Priority Data

Sep. 4, 2008 (JP) ..... 2008-226737

(51) Int. Cl.
*G09G 3/34* (2006.01)

(52) U.S. Cl.
USPC ..... 345/84

(58) Field of Classification Search
USPC ..... 345/84, 211, 214, 76–81; 313/462, 504
See application file for complete search history.

(56) References Cited

U.S. PATENT DOCUMENTS

2005/0206590 A1* 9/2005 Sasaki et al. ..... 345/76
2005/0258867 A1* 11/2005 Miyazawa ..... 326/83
2006/0170628 A1* 8/2006 Yamashita et al. ..... 345/76
2007/0115224 A1* 5/2007 Yamamoto et al. ..... 345/76
2007/0115225 A1* 5/2007 Uchino et al. ..... 345/76
2007/0124633 A1 5/2007 Kim
2007/0273620 A1 11/2007 Yumoto
2008/0203931 A1* 8/2008 Kim ..... 315/169.3
2008/0224621 A1* 9/2008 Uchino et al. ..... 315/169.3

FOREIGN PATENT DOCUMENTS

JP A-2007-133354 5/2007
JP A-2007-310311 11/2007
JP A-2007-316453 12/2007
JP A-2007-316454 12/2007
JP A-2007-316455 12/2007

* cited by examiner

*Primary Examiner* — Chanh Nguyen
*Assistant Examiner* — Pegeman Karimi
(74) *Attorney, Agent, or Firm* — Oliff & Berridge, PLC

(57) ABSTRACT

A method of driving a plurality of pixel circuits. The pixel circuits are disposed corresponding to intersections between a plurality of scanning lines and a plurality of signal lines. Each of the pixel circuits includes: a light emitting element; a driving transistor; a holding capacitor; and a selection switch electrically interconnecting the signal line and the gate of the driving transistor at the time of the selection of the scanning line. The method includes: supplying a gradation potential to each signal line during a first period, selecting the scanning line during a second period, and supplying the gradation potential to the gate of the driving transistor; controlling the driving transistor of each of the pixel circuits to be in an ON state, supplying a reference potential to the gate of the corresponding driving transistor, and executing a first compensation operation and supplying driving current to the light emitting element.

16 Claims, 9 Drawing Sheets

FIG. 6 ■ RESET PERIOD PRS (H[i−4] TO H[i−3])
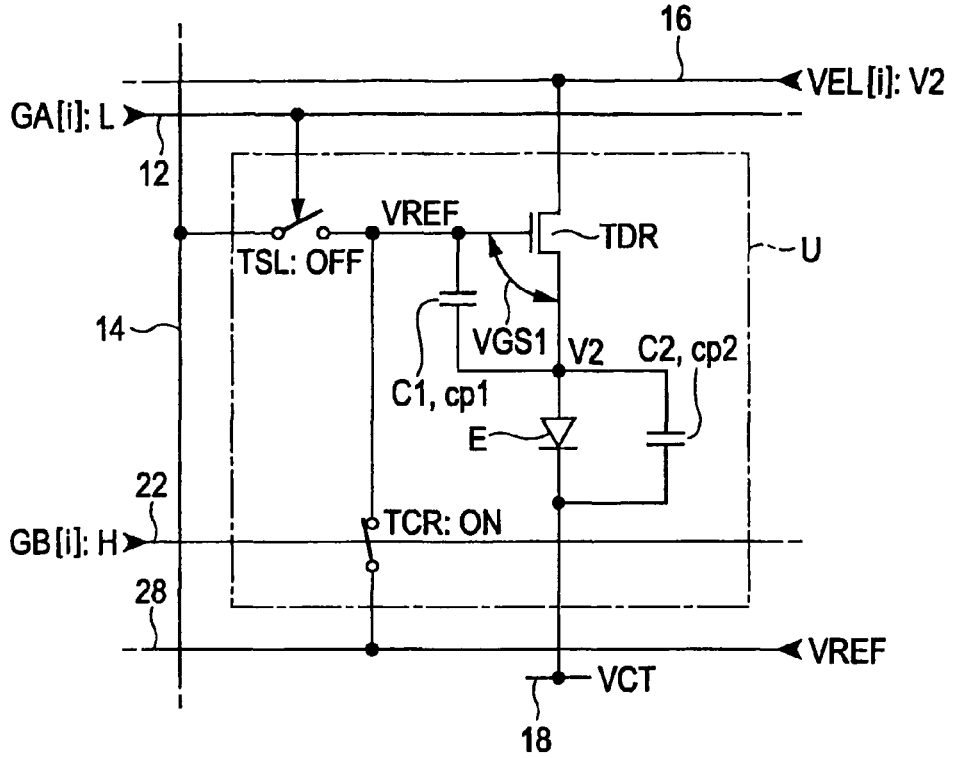
FIG. 7 ■ COMPENSATION PERIOD PCP (H[i−2] TO H[i−1])
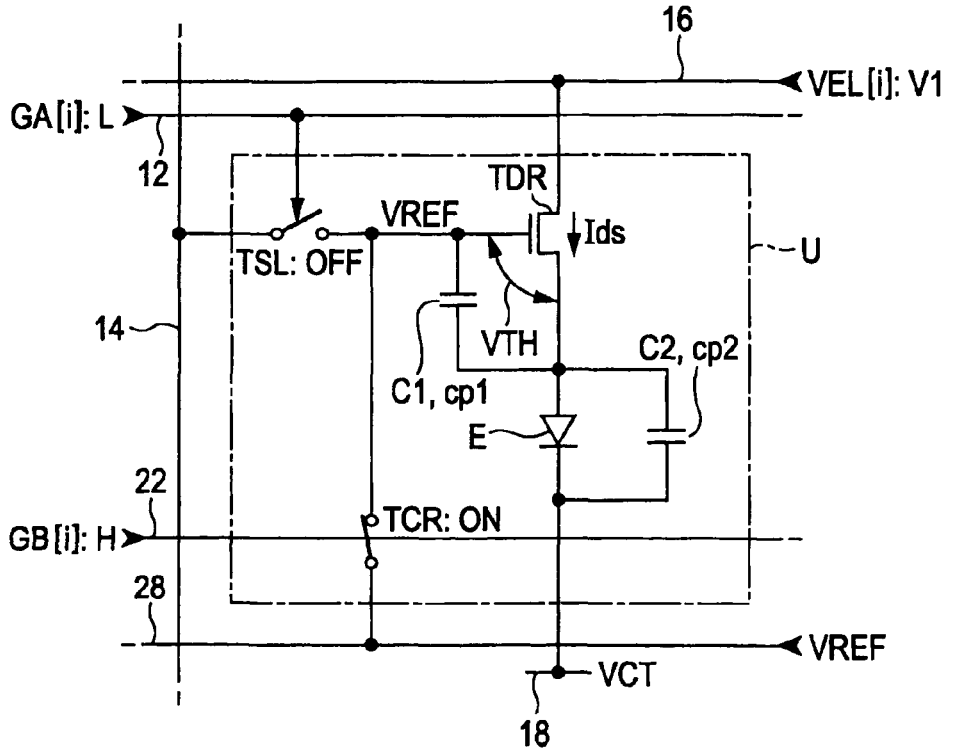

FIG. 8 ■ UNITARY PERIOD H[i] (RIGHT AFTER START OF PERIOD h2)
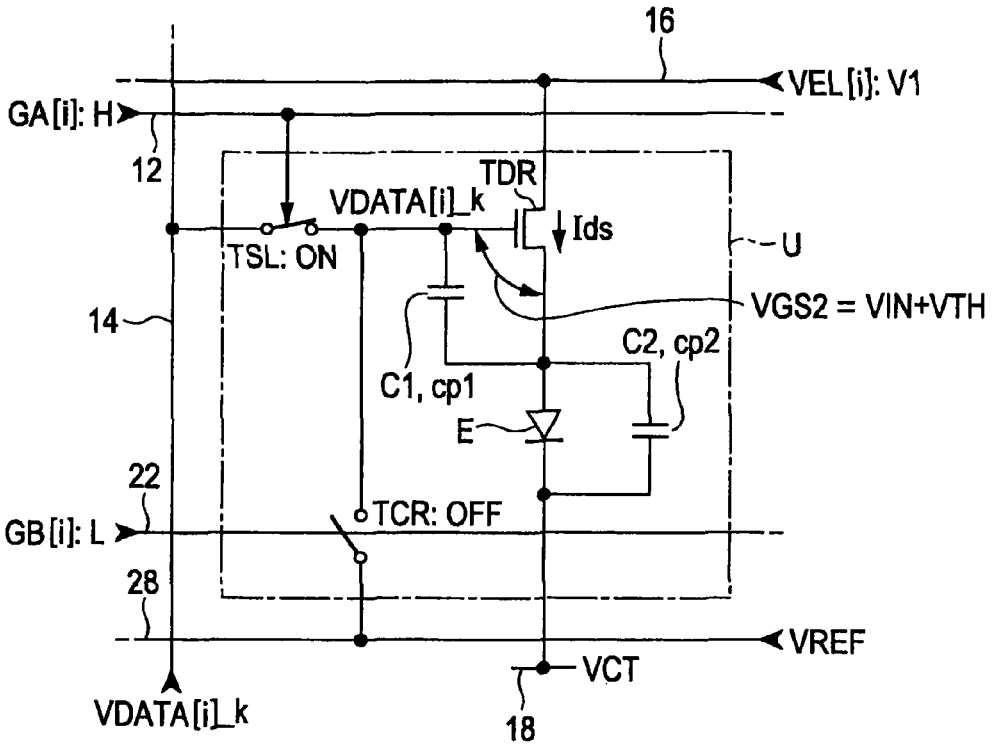
FIG. 9 ■ DRIVING PERIOD PDR
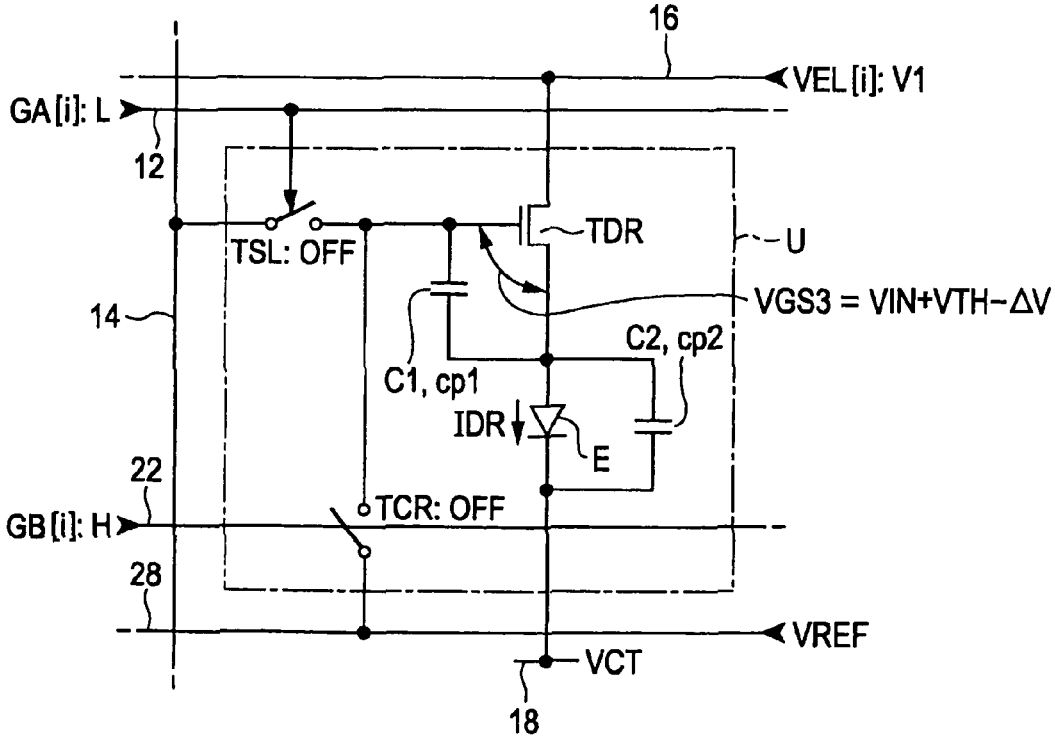

PIXEL CIRCUIT DRIVING METHOD, LIGHT EMITTING DEVICE, AND ELECTRONIC APPARATUS

This application claims priority to Japanese Application No. 2008-226737 filed in Japan on Sep. 4, 2008, the disclosure of which is hereby incorporated by reference in its entirety.

BACKGROUND

1. Technical Field

The present invention relates to a technique for driving a light emitting element such as an organic EL (Electroluminescence) element.

2. Related Art

A light emitting device is known in which the driving transistors control the driving current supplied to the light emitting elements. The light emitting device has a problem of an error (deviation from a target value or variation among the elements) in characteristics of the driving transistors. Japanese Unexamined Patent Application Publication No. 2007-310311 discloses a technique that compensates for errors (which may further include an error in an amount of the driving current) in mobility and threshold voltages of the driving transistors by sequentially executing a compensation operation and a recording operation on the pixel circuits of a selected row by a scanning line driving circuit for each horizontal scanning period. The compensation operation is an operation for making the voltage across each holding capacitor, which is interposed between a gate and a source of the driving transistor, approach asymptotically to a threshold voltage by controlling the driving transistor to be in an ON state and subsequently supplying a predetermined reference potential to the gate of the driving transistor from a signal line. The recording operation is an operation for changing the voltage of both ends of the holding capacitor into a voltage according to a gradation level by supplying a gradation potential according to the gradation level to the gate of the driving transistor from the signal line.

Meanwhile, considerable time is needed to make the voltage of both ends of the holding capacitor approach sufficiently to the threshold voltage of the driving transistor by using the compensation operation. However, in the technique disclosed in Japanese Unexamined Patent Application Publication No. 2007-310311, one signal line is used for both operations of supplying the reference potential and supplying the gradation potential. Thus, it is required to complete the compensation operation and the recording operation within a horizontal scanning period in which one scanning line is selected. This causes a problem in that a time for compensation operation is not sufficiently secured. When the time for the compensation operation is insufficient, it is difficult to make the voltage of both ends of the holding capacitor approach sufficiently to the threshold voltage of the driving transistor. Accordingly, it is difficult to effectively compensate the error in the threshold voltage of the driving transistor. On the other hand, when the horizontal scanning period is set to a time that is sufficient to make the voltage of both ends of the holding capacitor approach the threshold voltage of the driving transistor, another problem arises in that an increase (an increase in resolution) in the number of the scanning lines is restricted.

SUMMARY

An advantage of some aspects of the invention is to secure the time for the compensation operation while suppressing the time for the scanning line selection.

In order to solve the above-mentioned problems, a method of driving a plurality of pixel circuits according to a first aspect of the invention is provided. The pixel circuits are disposed corresponding to the intersections between a plurality of scanning lines and a plurality of signal lines. Each of the pixel circuits includes: a light emitting element; a driving transistor connected to the light emitting element in series; a holding capacitor interposed between a gate of the driving transistor and a path between the light emitting element and the driving transistor; and a selection switch electrically interconnecting the signal line and the gate of the driving transistor at the time of the scanning line selection. The method of driving the pixel circuits includes: supplying time-divisionally a gradation potential to each signal line during a first period (for example, the period h1 in FIG. 2) of each of a plurality of unitary periods, selecting the scanning line during a second period (for example, the period h2 in FIG. 2) after elapse of the first period of the corresponding unitary period, and supplying the gradation potential to the gate of the driving transistor of each of the pixel circuits corresponding to the selected scanning line; controlling the driving transistor of each of the pixel circuits corresponding to one scanning line of the plurality of scanning lines to be in an ON state, supplying a reference potential from an electric supply line to the gate of the corresponding driving transistor, and executing a first compensation operation for making the voltage across the holding capacitor approach asymptotically to a threshold voltage of the driving transistor before the start of the unitary period corresponding to the one scanning line; and supplying driving current to the light emitting element in accordance with the voltage across the holding capacitor after elapse of the unitary period corresponding to the one scanning line.

In this aspect of the invention, the reference potential is supplied to the gate of the driving transistor in the pixel circuit from the electric supply line different from the signal line used for supplying the gradation potential, thereby executing the first compensation operation before the start of the unitary period in which the gradation potential is supplied to the corresponding pixel circuit. Accordingly, it is possible to secure the time for the first compensation operation while suppressing the time for the scanning line selection as compared with the configuration disclosed in Japanese Unexamined Patent Application Publication No. 2007-310311 that requires the execution of the first compensation operation during the selection of the scanning line (during the selection switch is in a conductive state). In addition, it is possible to secure a time for time-divisionally supplying the gradation potential to each signal line during the first period of the unitary period since it is not necessary to execute the first compensation operation during the selection of the scanning line (specifically, it is possible to reduce a speed required to supply the gradation potential to each signal line).

In this aspect of the invention, it is preferred that the time for the first compensation operation be determined to make the voltage of both ends of the holding capacitor reach the threshold voltage of the driving transistor through the first compensation operation. In this case, even when the voltage of both ends of the holding capacitor does not completely coincide with the threshold voltage of the driving transistor, the threshold voltage of the driving transistor is reflected in the voltage of both ends of the holding capacitor by the first compensation operation. Although the effect of error compensation of the threshold voltage is reduced as compared with the case where the voltage of both ends of the holding capacitor is made to coincide with threshold voltage of the driving transistor, the effect is apparently realized even when the voltage of both ends of the holding capacitor does not completely coincide with the threshold voltage of the driving transistor. Accordingly, it is not essential for this aspect of the invention to make the voltage of both ends of the holding capacitor completely coincide with the threshold voltage of the driving transistor by using the first compensation operation.

In the method according to this aspect of the invention, it is preferred that a second compensation operation for making the voltage across the holding capacitor approach asymptotically to the threshold voltage of the driving transistor be executed after the supply of the gradation potential to the gate of the driving transistor, during the second period of each of the plurality of unitary periods. In the above aspect, since the voltage of both ends of the holding capacitor is made to approach asymptotically to the threshold voltage of the driving transistor by using the second compensation operation after the supply of the gradation potential, it is possible to compensate an error in mobility of the driving transistor. In addition, the time for the second compensation operation is set shorter than the time required for making the voltage of both ends of the holding capacitor reach the threshold voltage of the driving transistor.

In the method according to this aspect of the invention, it is preferred that the first compensation operation be executed during the two or more unitary periods (for example, the unitary periods H[i−2] to H[i−1] in FIG. 5) before the start of the unitary period corresponding to the one scanning line. In the above aspect, since the two or more unitary periods are used in the first compensation operation, it is possible to make the voltage of both ends of the holding capacitor approach sufficiently to the threshold voltage of the driving transistor. As a result, this aspect is advantageous in that the error of the threshold voltage of the driving transistor can be effectively compensated.

In addition, it is possible to omit the processing of time-divisionally supplying the gradation potential to each signal line in that the first compensation operation is executed before the start of the unitary period. Specifically, a method of driving a plurality of pixel circuits according to another aspect of the invention may be provided. The pixel circuits are disposed corresponding to intersections between a scanning line and a plurality of signal lines. Each of the pixel circuits includes: a light emitting element; a driving transistor connected to the light emitting element in series; a holding capacitor interposed between a gate of the driving transistor and a path between the light emitting element and the driving transistor; and a selection switch electrically interconnecting the signal line and the gate of the driving transistor at the time of the selection of the scanning line. The method of driving the pixel circuits includes: selecting the scanning line and supplying a gradation potential to the signal line during each of a plurality of unitary periods; controlling the driving transistor of each of the pixel circuits corresponding to one scanning line of the plurality of scanning lines to be in an ON state, supplying a reference potential from an electric supply line to the gate of the corresponding driving transistor, and executing a first compensation operation for making the voltage across the holding capacitor approach asymptotically to a threshold voltage of the driving transistor before start of the unitary period corresponding to the one scanning line; and supplying driving current to the light emitting element in accordance with the voltage across the holding capacitor after elapse of the unitary period corresponding to the one scanning line. In the above-mentioned driving method, it is also possible to secure the time for the first compensation operation while suppressing the time for the scanning line selection.

A light emitting device according to a second aspect of the invention includes: a plurality of pixel circuits which are disposed corresponding to intersections between a plurality of scanning lines and a plurality of signal lines and each of which includes a light emitting element, a driving transistor connected to the light emitting element in series, a holding capacitor interposed between a gate of the driving transistor and a path between the light emitting element and the driving transistor, a selection switch electrically interconnecting the signal line and the gate of the driving transistor at the time of the selection of the scanning line; and a driving circuit which individually drives the plurality of pixel circuits. In the device, the driving circuit supplies time-divisionally a gradation potential to each signal line during a first period of each of a plurality of unitary periods, selects the scanning line during a second period after elapse of the first period of the corresponding unitary period, and supplies the gradation potential to the gate of the driving transistor of each of the pixel circuits corresponding to the selected scanning line. In addition, the driving circuit controls the driving transistor of each of the pixel circuits corresponding to one scanning line of the plurality of scanning lines to be in an ON state, supplies a reference potential from an electric supply line to the gate of the corresponding driving transistor, and executes a first compensation operation for making the voltage across the holding capacitor approach asymptotically to a threshold voltage of the driving transistor before start of the unitary period corresponding to the one scanning line. In addition, the driving circuit supplies driving current to the light emitting element in accordance with the voltage across the holding capacitor after elapse of the unitary period corresponding to the one scanning line. The above-mentioned light emitting device has the same effect as the method of driving the pixel circuits according to the first aspect of the invention.

Further, a light emitting device according to another aspect of the invention may be provided. The light emitting device includes: a plurality of pixel circuits which are disposed corresponding to intersections between a scanning line and a plurality of signal lines and each of which includes a light emitting element, a driving transistor connected to the light emitting element in series, a holding capacitor interposed between a gate of the driving transistor and a path between the light emitting element and the driving transistor, a selection switch electrically interconnecting the signal line and the gate of the driving transistor at the time of the selection of the scanning line; and a driving circuit which individually drives the plurality of pixel circuits. In the device, the driving circuit selects the scanning line and supplies a gradation potential to the signal line during each of a plurality of unitary periods. In addition, the driving circuit controls the driving transistor of each of the pixel circuits corresponding to one scanning line of the plurality of scanning lines to be in an ON state, supplies a reference potential from an electric supply line to the gate of the corresponding driving transistor, and executes a first compensation operation for making the voltage across the holding capacitor approach asymptotically to a threshold voltage of the driving transistor before start of the unitary period corresponding to the one scanning line. In addition, the driving circuit supplies driving current to the light emitting element in accordance with the voltage across the holding capacitor after elapse of the unitary period corresponding to the one scanning line. By adopting the light emitting device according to the above aspect, it is possible to secure the time for the first compensation operation while suppressing the time for the scanning line selection.

In the light emitting device according to this aspect of the invention, it is preferred that each of the plurality of pixel circuits include a control switch interposed between the electric supply line and the gate of the driving transistor. In addition, it is also preferred that the driving circuit regulate the control switch of each of the pixel circuits to be in an ON state during the execution of the first compensation operation and to be in an OFF state during the unitary period, in which the scanning line corresponding to the pixel circuit is selected, and during the supply of the driving current to the light emitting element. According to the above aspect, the device has an advantage in that the period of supplying the reference potential to the pixel circuit from the electric supply line can be accurately set with a simple configuration.

The light emitting device according to the above aspects can be used in various electronic apparatuses. Typical examples of the electronic apparatuses are apparatuses using the light emitting device as a display device. A personal computer and a mobile phone are shown as examples of the electronic apparatuses in the embodiment of the invention. A use of the light emitting device according to the aspects of the invention is not limited to display of an image. For example, the light emitting device according to the aspects of the invention may be applied as an exposure device (an optical head) for forming a latent image on an image carrier such as a photosensitive drum by irradiation of a ray.

BRIEF DESCRIPTION OF THE DRAWINGS

The invention will be described with reference to the accompanying drawings, wherein like numbers reference like elements.

FIG. 6 is a circuit diagram illustrating an aspect of the pixel circuit during a reset period.

FIG. 7 is a circuit diagram illustrating an aspect of the pixel circuit during a compensation period.

FIG. 8 is a circuit diagram illustrating an aspect of the pixel circuit right after supply of a gradation potential.

FIG. 9 is a circuit diagram illustrating an aspect of the pixel circuit during a driving period.

DETAILED DESCRIPTION OF EMBODIMENTS

A. Preferred Embodiments

Figure 1:
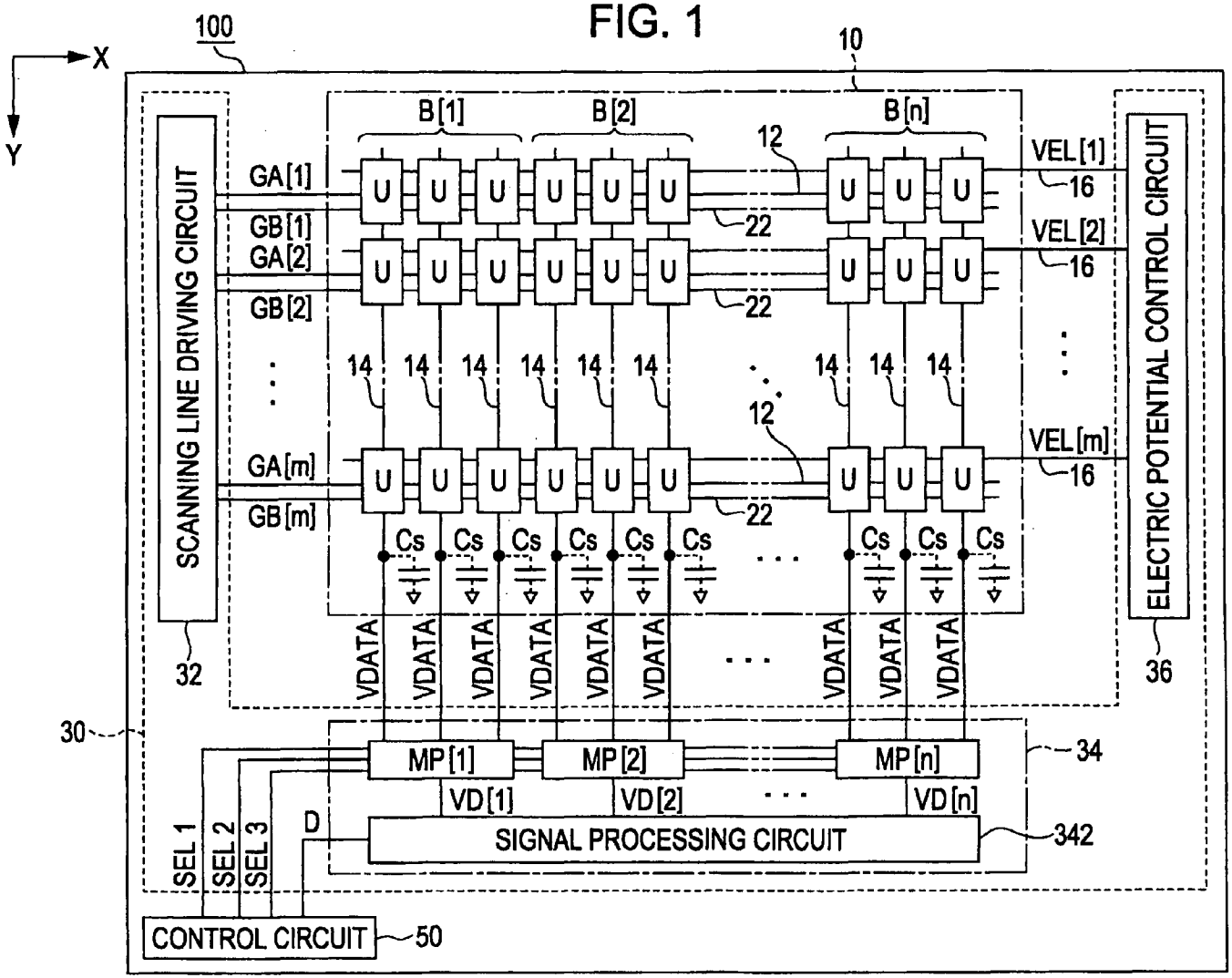
FIG. 1 is a block diagram illustrating a light emitting device according to the embodiment of the invention.

FIG. 1 is a block diagram illustrating a light emitting device according to the embodiment of the invention. The light emitting device 100 is mounted, for example, as a display device for displaying an image on an electronic apparatus. As shown in FIG. 1, the light emitting device 100 includes: an element section 10 in which a plurality of pixel circuits U are arranged; a driving circuit 30 which drives the pixel circuits U; and a control circuit 50 which controls the driving circuit 30. The driving circuit 30 is configured to include a scanning line driving circuit 32, a signal line driving circuit 34, and an electric potential control circuit 36. In addition, the driving circuit 30 is mounted to be divided into, for example, a plurality of integrated circuits. However, at least a part of the driving circuit 30 can include thin film transistors formed on a substrate on which the pixel circuits U are disposed.

The element section 10 includes m scanning lines 12 which extend in the X direction, m electric supply lines 16 and m control lines 22 which extend in the X direction with the scanning lines 12, and 3n signal lines 14 which extend in a Y direction orthogonal to the X direction (m and n are natural numbers). The plurality of pixel circuits U are disposed corresponding to intersections of the scanning line 12 and the signal lines 14, and are arranged in an array of m columns×3n rows. Each pixel circuit U corresponds to any one of a plurality of display colors (red, green, and blue). The red pixel circuit U emits red light, the green pixel circuit U emits green light, and the blue pixel circuit U emits blue light.

As shown in FIG. 1, the 3n signal lines 14 are divided into n blocks B (B[1] to B[n]) when the three signal lines adjacent to each other are set as a unit. The signal line 14 at each first column of the blocks B[1] to B[n] is connected with the m red pixel circuits U arranged in the Y direction. Likewise, the signal line 14 at each second column of the blocks B[1] to B[n] is connected with the m green pixel circuits U. In addition, the signal line 14 at each third column thereof is connected with the m blue pixel circuits U. The m pixel circuits U arranged in the Y direction correspond to the same display color (a stripe array). The shape of display color arrangement is optionally changed.

The scanning line driving circuit 32 outputs scanning signals GA[1] to GA[m] to the scanning lines 12, and outputs control signals GB[1] to GB[m] to the control lines 22. Here, it is possible to adopt a configuration in which the scanning signals GA[1] to GA[m] and the control signals GB[1] to GB[m] are generated by separate circuits. The signal line driving circuit 34 outputs gradation potentials VDATA according to gradation levels D, which is designated to the pixel circuits U, to the signal lines 14. The electric potential control circuit 36 generates electric potentials VEL[1] to VEL [m] and outputs those to the electric supply lines 16.

The control circuit 50 outputs a signal (a synchronization signal or a control signal) for specifying an operation of the light emitting device 100 to the driving circuit 30. For example, the control circuit 50 outputs the gradation levels D for specifying gradation (brightness) of pixel circuits U and selection signals SEL_1 to SEL_3 for specifying an operation of the signal line driving circuit 34 to the signal line driving circuit 34.

Figure 2:
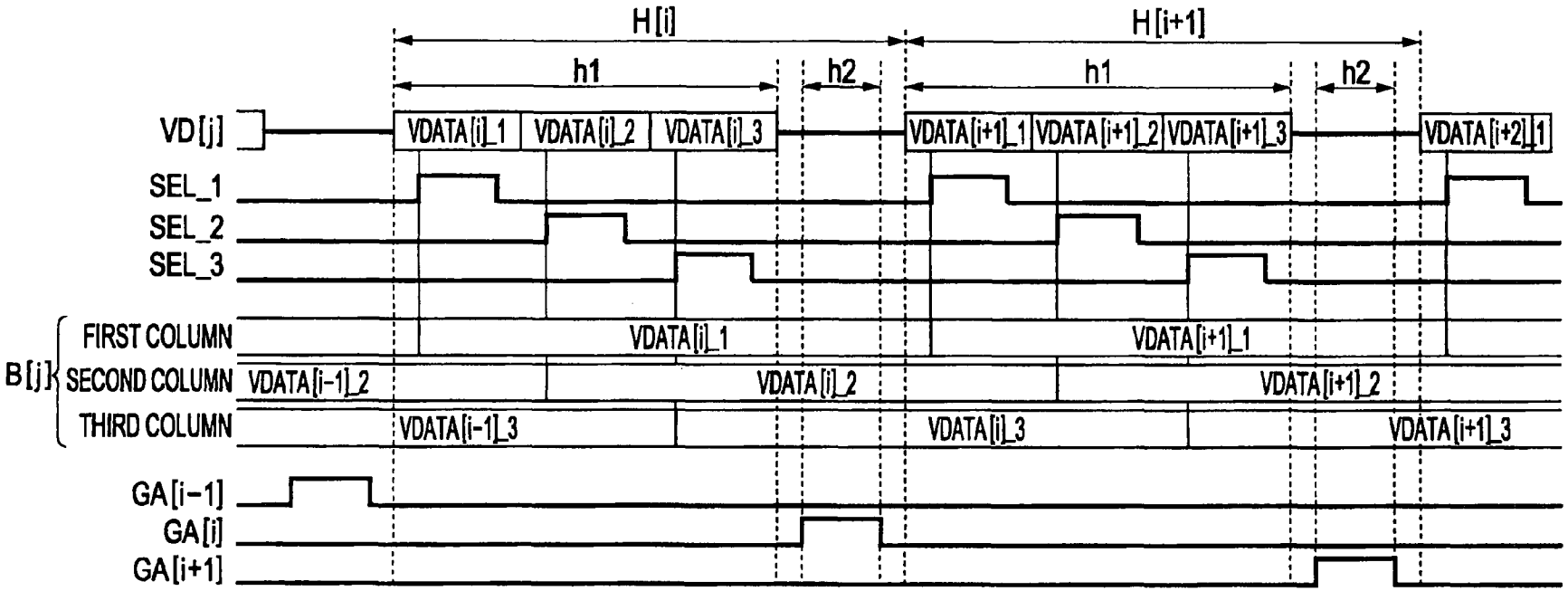
FIG. 2 is a timing chart illustrating operations of a scanning line driving circuit and a signal line driving circuit.

FIG. 2 is a timing chart illustrating the operations of the scanning line driving circuit 32 and the signal line driving circuit 34. Each frame period (vertical scanning period) includes m unitary periods H (H[1] to H [m]) corresponding to the m scanning lines 12. As shown in FIG. 2, each of the unitary periods (horizontal scanning period) H[1] to H [m] includes a period h1 and a period h2. The period h2 is a period after elapse of the period h1. The scanning signals GA[1] to GA[m] are sequentially set to an active level (a high level) during the respective periods h2 of the m unitary periods H[1] to H[m]. Specifically, the scanning signal GA[i] supplied to the scanning line 12 of the i-th row (i=1 to m) is set to the active level during the period h2 of the unitary period H[i], and is maintained at a non-active level out of the period h2.

As shown in FIG. 1, the signal line driving circuit 34 includes a signal processing circuit 342 and n distribution circuits MP (MP[1] to MP[n]) corresponding to the n blocks B[1] to B[n]. The signal processing circuit 342 is mounted, for example, as an integrated circuit on a substrate. The distribution circuits MP[1] to MP[n] are formed, for example, as thin film transistors on the substrate. The signal processing circuit 342 generates n-phase image signals VD[1] to VD[n] from the gradation levels D of pixel circuits U output from the control circuit 50, and outputs the generated signals in parallel. The j-th (j=1 to n) distribution circuit MP[j] is a circuit (a demultiplexer) for distributing the image signal VD[j] to the three signal lines 14 of the block B[j].

The image signal VD[j] output from the signal processing circuit 342 is a voltage signal for time-divisionally specifying the gradation levels D of the pixel circuits U corresponding to the j-th block B[j]. Specifically, the image signal VD[j] is sequentially set to the gradation potentials VDATA (VDATA [i]_1 to VDATA[i]_3) according to the gradation levels D of the three pixel circuits U included in the block B[j] among the m pixel circuits U of the i-th row, during the period h1 of the unitary period H[i] as shown in FIG. 2. The gradation potential VDATA[i]_k (k=1 to 3) of the image signal VD[j] is set variably in accordance with the gradation level D of the pixel circuit U of k-th column in the block B[j] among the n pixel circuits U of the i-th row. As shown in FIG. 1, the image signal VD[j] is supplied to the distribution circuit MP[j].

Figure 3:
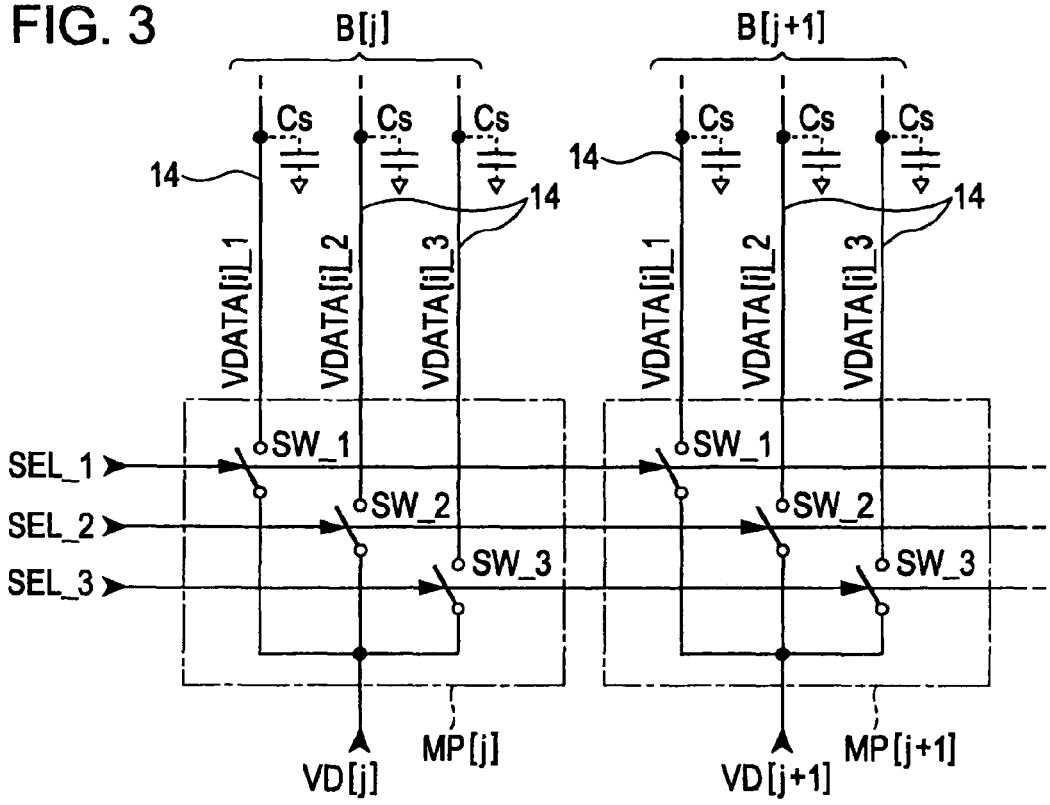
FIG. 3 is a circuit diagram illustrating distribution circuits.

FIG. 3 is a circuit diagram illustrating distribution circuits MP. FIG. 3 representatively shows only two distribution circuits MP (MP[j] and MP[j+1]). As shown in FIG. 3, the distribution circuit MP[j] includes three switches SW (SW_1 to SW_3) corresponding to the number of the signal lines 14 in the block B[j]. The switch SW_k of the distribution circuit MP[j] is interposed between an output terminal of the image signal VD[j] in the signal processing circuit 342 and the signal line 14 of the k-th column in the block B[j], and controls electric connection (conduction or non-conduction) therebetween.

As shown in FIGS. 1 and 3, three type selection signals SEL_1 to SEL_3 are supplied to the n distribution circuits MP[1] to MP[n] from the control circuit 50. The selection signal SEL_k is supplied to the switch SW_k in each of the distribution circuits MP[1] to MP[n], and controls on and off operations of the switch. As shown in FIG. 2, selection signals SEL_1 to SEL_3 sequentially reach the active level during the period h1 within each unitary period H. In addition, the selection signal SEL_k is set to the active level within the period in which the image signal VD[j] is turned into the gradation potential VDATA[i]_k of the k-th column pixel circuit U in the block B[j] in each of the unitary periods H[1] to H[m].

When a level of the selection signal SEL_k transits to the active level during the period h1 of the unitary period H [i], the gradation potential VDATA[i]_k which is set by the image signal VD[j] is supplied to the k-th column signal line 14 of the block B[j] through the switch SW_k of the distribution circuit MP[j]. Since capacitors CS are associated with the respective signal lines 14 as shown in FIGS. 1 and 3, the gradation potential VDATA[i]_k supplied to the signal line 14 is maintained in the signal line 14 until the selection signal SEL_k is set to the active level again during the right next unitary period H[i+1]. Specifically, the electric potential of the k-th column signal line 14 included in the block B[j] is set to the gradation potential VDATA[i]_k according to the gradation level D, which is specified in the pixel circuit U corresponding to intersection between the corresponding signal line 14 and the i-th row scanning line 12, during the period h2 in which the level of the scanning signal GA[i] is turned into the active level in the unitary period H[i].

Figure 4:
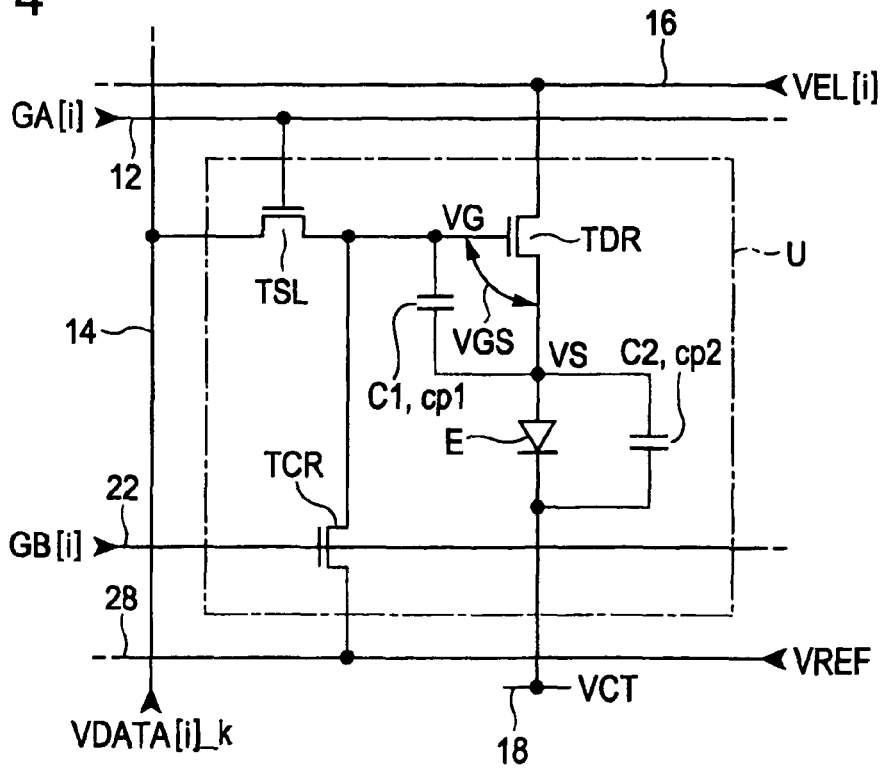
FIG. 4 is a circuit diagram illustrating a pixel circuit.

Next, FIG. 4 is a circuit diagram illustrating the pixel circuit U. FIG. 4 representatively shows one pixel circuit U, which is located on the k-th column of the block B[j], among the n pixel circuits U of the i-th row. As shown in FIG. 4, the pixel circuit U is configured to include a light emitting element E, a driving transistor TDR, a holding capacitor C1, a selection switch TSL, and a control switch TCR. The selection switch TSL and the control switch TCR are N-channel type transistors (for example, thin film transistors).

The light emitting element E and the driving transistor TDR are disposed in series in the path between an electric supply line 16 and an electric supply line (grounding wire) 18. The electric supply line 18 is supplied with a predetermined electric potential VCT from the power supply circuit (not shown in the drawing). The light emitting element E is an organic EL element in which a light emitting layer made of an organic EL (Electroluminescence) material is interposed between anodes and cathodes facing each other. As shown in FIG. 4, a capacitor C2 (capacitance cp2) is associated with the light emitting element B.

The driving transistor TDR is an N-channel type transistor (for example thin film transistor) of which a drain is connected to the electric supply line 16 and of which a source is connected to the anode of the light emitting element E. The holding capacitor C1 (capacitance cp1) is interposed between the source of the driving transistor TDR (that is, the path between the light emitting element E and the driving transistor TDR) and the gate of the driving transistor TDR.

The selection switch TSL is interposed between the signal line 14 and the gate of the driving transistor TDR, and controls electric connection (conduction or non-conduction) between those. A gate of the selection switch TSL of each pixel circuit U of the i-th row is commonly connected to the i-th row scanning line 12.

The control switch TCR is interposed between the gate of the driving transistor TDR and the electric supply line 28, and controls electric connection (conduction or non-conduction) between those. The electric supply line 28 is supplied with a reference potential VREF from the power supply circuit (not shown in the drawing). The electric supply line 28 is for example, a wire (or a wire which is formed for each column, and extends in the Y direction) which is individually formed for each row of the pixel circuit U, and extends in the X direction as shown in FIG. 4, or a wire which extends over the pixel circuits U in the element section 10. A gate of the control switch TCR of each pixel circuit U of the i-th row is commonly connected to the i-th row control line 22.

Figure 5:
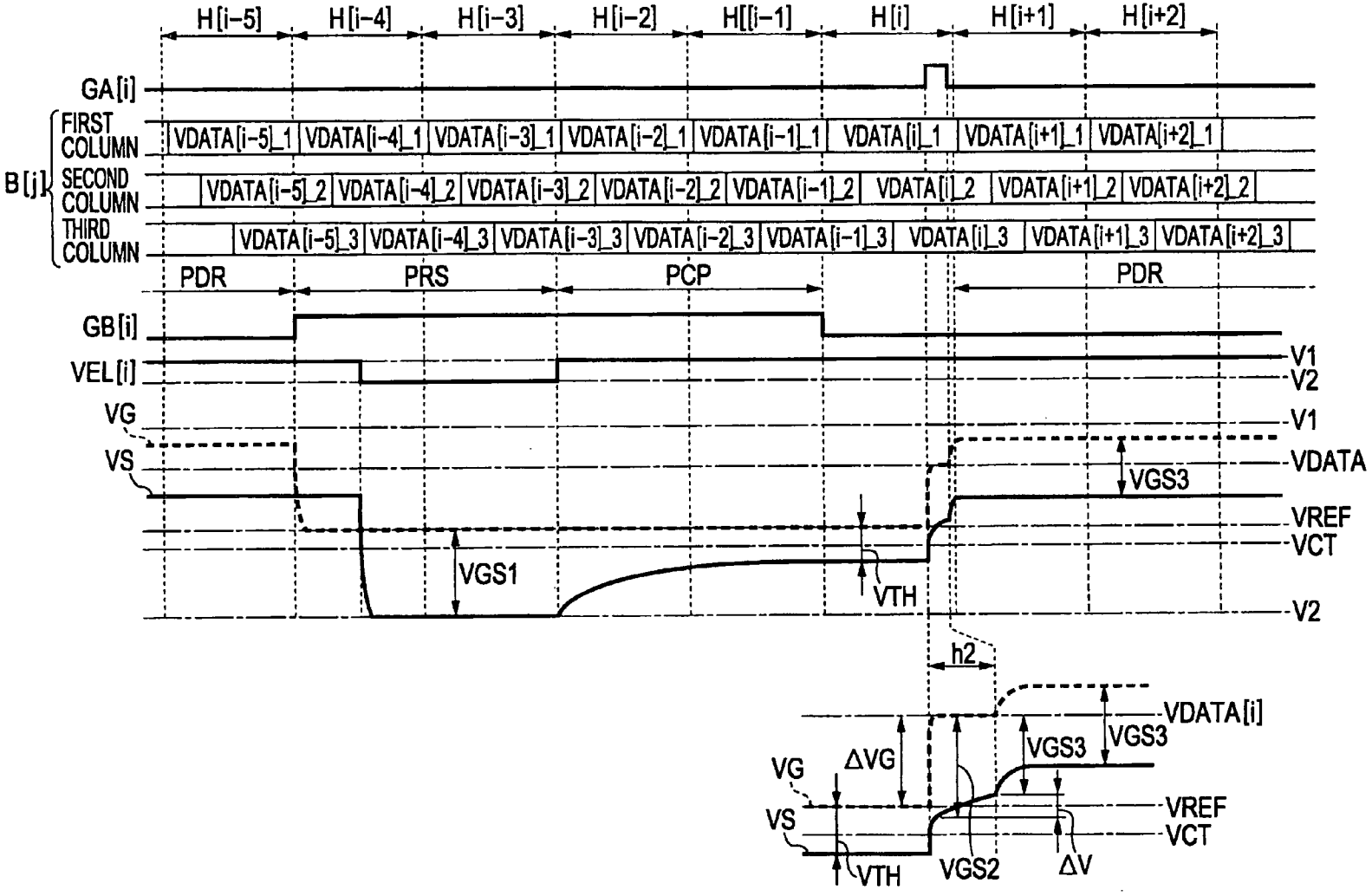
FIG. 5 is a timing chart illustrating an operation of the pixel circuit.

Next, FIG. 5 is a timing chart illustrating an operation (a method of driving the pixel circuit U) of the driving circuit 30. FIG. 5 representatively shows the operation of the pixel circuit U of the i-th row. As shown in FIG. 5, in the pixel circuits U of the i-th row, a first compensation operation is executed during a compensation period PCP before start of the unitary period H[i] of the i-th row, and a reset operation is executed during the reset period PRS before start of the compensation period PCP.

The reset operation resets a gate-source voltage VGS which is applied between the gate and the source of the driving transistor TDR (that is, between both ends of the holding capacitor C1) to a predetermined voltage VGS1 independent of the gradation level D. The first compensation operation is an operation for making the voltage VGS of the driving transistor TDR approach asymptotically to the threshold voltage VTH of the driving transistor TDR from the voltage VGS1 which is set by the reset operation. During the unitary period H[i] after elapse of the compensation period PCP of the i-th row, the voltage VGS is set to a voltage according to the gradation potential VDATA[i]_k of the signal line 14. Specifically, the unitary period H[i] is used as a period (a recording period) for recording the gradation potential VDATA in each pixel circuit U of the i-th row. During the driving period PDR after elapse of the unitary period H[i], a driving current IDR according to the voltage VGS is supplied from the electric supply line 16 to the light emitting element E through the driving transistor TDR. The light emitting element E emits light with brightness according to the driving current IDR.

As shown in FIG. 5, the plural (two) unitary periods H (H[i−2] and H[i−1]) right before the unitary period H[i] are used as the compensation period PCP of the i-th row, and two unitary periods H (H[i−4] and H[i−3]) before start of the compensation period PCP are used as the reset period PRS of the i-th row. The scanning line driving circuit 32 sets a control signal GB[i] to the active level (a high level) during the compensation period PCP and the reset period PRS of the i-th row (the unitary periods H[i−4] to H[i−1]), and maintains the control signal GB[i] at the non-active level (a low level) out of the corresponding periods. In addition, the electric potential control circuit 36 sets an electric potential VEL[i] to an electric potential V2 in the range from the time point in the course of the reset period PRS to the end point of the reset period PRS, and maintains the electric potential VEL[i] at the electric potential V1 out of the corresponding period.

Next, detailed operations of the pixel circuit U according to the reset period PRS, the compensation period PCP, the unitary period H[i], and the driving period PDR will be described.

1. Reset Period PRS (FIG. 6)

As shown in FIGS. 5 and 6, the control signal GB[i] is set to the active level during the i-th row reset period PRS (H[i−4] and H[i−3]), and thus the control switch TCR is controlled to be in an ON state. Since the selection switch TSL maintains an OFF state, an electric potential VG of the gate of the driving transistor TDR is set to the reference potential VREF of the electric supply line 28 through the control switch TCR. On the other hand, after the start of the reset period PRS (at the time point in the course of the unitary period H[i−4]), the electric potential control circuit 36 supplies the electric potential V2 (the electric potential VEL[i]) to the electric supply line 16. Thus, the electric potential VS of the source of the driving transistor TDR is set to the electric potential V2. Specifically, the voltage VGS between the gate and the source of the driving transistor TDR (between both ends of the holding capacitor C1) is reset to a voltage VGS1 (VGS1=VREF−V2) obtained by subtracting the electric potential V2 from the reference potential VREF. In addition, the time point at which a level of the control signal GB[i] is changed into the active level may be the same as the time point at which the electric potential VEL[i] is changed into the electric potential V2.

The reference potential VREF and the electric potential V2 are set so that the voltage VGS1, which is the difference of those, is much larger than the threshold voltage VTH of the driving transistor TDR as represented by the following Expression 1 and a voltage (V2−VCT) between the both ends of the light emitting element E is much smaller than a threshold voltage VTH_OLED of the light emitting element E as represented by the following Expression 2. Accordingly, during the reset period PRS, the driving transistor TDR is in the ON state, and the light emitting element E is in the OFF state (a non-light emission state).

$$VGS1=VREF-V2>>VTH \quad \text{Expression 1}$$

$$V2-VCT<<VTH_OLED \quad \text{Expression 2}$$

2. Compensation Period PCP (FIG. 7)

As shown in FIGS. 5 and 7, when the compensation period PCP is started, the electric potential control circuit 36 changes the electric potential VEL[i] (the electric potential of the drain of the driving transistor TDR) of the electric supply line 16 into the electric potential V1. As shown in FIG. 5, the electric potential V1 is much larger than the electric potential V2 and the reference potential VREF. On the other hand, the control switch TCR is controlled to still remain in the ON state from the reset period PRS. Thus, the electric potential VG of the gate of the driving transistor TDR is also maintained at the reference potential VREF during the compensation period PCP.

Since the driving transistor TDR is turned to the ON state during the reset period PRS, a current Ids represented by the following Expression 3 flows between the drain and the source of the driving transistor TDR as shown in FIG. 7. In Expression 3, μ is defined as a mobility of the driving transistor TDR. In addition, W/L is defined as a relative ratio of a channel width W to a channel length L of the driving transistor TDR, and Cox is defined as a capacitance per unit area of a gate insulation film of the driving transistor TDR.

$$Ids=\tfrac{1}{2}\cdot\mu\cdot W/L\cdot Cox\cdot(VGS-VTH)^2 \quad \text{Expression 3}$$

The current Ids flows to the driving transistor TDR, whereby the holding capacitor C1 and the capacitor C2 are charged. Accordingly, as shown in FIG. 5, the electric potential VS of the source of the driving transistor TDR gradually increases. Since the electric potential VG of the gate of the driving transistor TDR is maintained at the reference potential VREF, the gate-source voltage VGS of the driving transistor TDR decreases in accordance with the increase of the electric potential VS of the source. As can be understood from Expression 3, the current Ids decreases as the voltage VGS is lowered and approaches to the threshold voltage VTH. Accordingly, during the compensation period PCP, the first compensation operation is executed which makes the voltage VGS of the driving transistor TDR approach asymptotically to the threshold voltage VTH from the voltage VGS1 (VGS1=VREF−V2) which is set during the reset period PRS. As shown in FIGS. 5 and 7, a time length (the number of the unitary periods H) of the compensation period PCP is set so that the voltage VGS of the driving transistor TDR sufficiently approaches to (ideally coincides with) the threshold voltage VTH at the end point of the compensation period PCP. As a result, the driving transistor TDR is in the OFF state at the end point of the compensation period PCP.

3. Unitary Period H[i] (FIG. 8)

As shown in FIG. 5, when the unitary period H[i] is started, the control signal GB[i] is set to the non-active level, thereby turning the control switch TCR to the OFF state. That is, the supply of the reference potential VREF to the gate of the driving transistor TDR is stopped.

As shown in FIG. 8, when the period h2 of the unitary period H[i] comes, the scanning signal GA[i] is set to the active level, thereby turning the selection switch TSL into the ON state. The gate of the driving transistor TDR is electrically connected to the signal line 14 through the selection switch TSL. As can be understood from FIG. 2, during the period h2 of the unitary period H[i], the gradation potential VDATA[i]_k is supplied to the k-th column signal line 14 of the block B[j]. Hence, the electric potential VG of the gate of the driving transistor TDR changes (increases) to the gradation potential VDATA[i]_k from the reference potential VREF at the start point of the unitary period H[i].

Since the holding capacitor C1 is interposed between the gate and the source of the driving transistor TDR, as shown in the enlarged view of FIG. 5, the electric potential VS of the source of the driving transistor TDR changes (increases) depending on the electric potential VG of the gate thereof. An amount of change of the electric potential VS right after the start of the period h2 corresponds to a voltage (ΔVG·cp1/(cp1+cp2)) obtained by dividing an amount of change ΔVG (ΔVG=VDATA−VREF) of the electric potential VG in accordance with a capacitance ratio of the holding capacitor C1 and the capacitor C2. Accordingly, the voltage VGS2 between the gate and the source of the driving transistor TDR (between both ends of the holding capacitor C1) right after the start of the period h2 is represented by the following Expression 4 as shown in FIG. 8. In Expression 4, a voltage VIN corresponds to the amount of change (ΔVG·cp2/(cp1+cp2)) of the gate-source voltage VGS of the driving transistor TDR at the time of the supply of the gradation potential VDATA to the gate of the driving transistor TDR.

$$VGS2 = VTH + \Delta VG \cdot cp2/(cp1 + cp2) = VIN + VTH \quad \text{Expression 4}$$

As described above, the gate-source voltage VGS2 is set to be larger than the threshold voltage VTH in accordance with the gradation potential VDATA (more specifically, difference ΔVG between the gradation potential VDATA and the reference potential VREF), thereby turning the driving transistor TDR into the On state. As a result, the current Ids of Expression 3 flows between the drain and the source of the driving transistor TDR.

As shown in FIG. 5 (the enlarged view), the electric potential VS (the voltage between both ends of the capacitor C2) of the source of the driving transistor TDR gradually increases as the holding capacitor C1 and the capacitor C2 are charged by the current Ids. On the other hand, the electric potential VG of the gate of the driving transistor TDR is maintained at the gradation potential VDATA[i]_k within the period h2. Accordingly, the voltage VGS between the gate and the source of the driving transistor TDR decreases from the voltage VGS2 right after the start of the period h2 as the electric potential VS increases. As the voltage VGS approaches to the threshold voltage VTH, the current Ids decreases. Hence, similarly to the compensation period PCP, during the period h2, an operation (hereinafter, it is referred to as a "second compensation operation") is executed which makes the voltage VGS of the driving transistor TDR approach asymptotically to the threshold voltage VTH from the voltage VGS2 set by the supply of the gradation potential VDATA[i]_k.

The period h2 is limited to a time shorter than a time required to allow the second compensation operation to decrease the voltage VGS of the driving transistor TDR up to the threshold voltage VTH. Accordingly, as shown in FIG. 5, the voltage VGS at the end point of the period h2 is set to a voltage VGS3 represented by Expression 5. The voltage VGS3 is lower by a voltage ΔV than the voltage VGS2 represented by Expression 4. The voltage ΔV corresponds to an amount of change of the electric potential VS of the source of the driving transistor TDR due to the second compensation operation.

$$VGS3 = VGS2 - \Delta V = VIN + VTH - \Delta V \quad \text{Expression 5}$$

4. Driving Period PDR (FIG. 9)

As shown in FIG. 9, when the unitary period H[i] (the period h2) is elapsed, the scanning signal GA[i] is set to the non-active level, thereby turning the selection switch TSL into the OFF state. Since the control signal GB[i] is still set to the non-active level from the unitary period H[i], the control switch TCR maintains the OFF state. Accordingly, the gate of the driving transistor TDR is in an electrically floating state in which the gate is isolated from the signal line 14 and the electric supply line 28. That is, the supply of the electric potential to the gate of the driving transistor TDR is stopped.

When the driving transistor TDR is in the ON state at the end point of the unitary period H[i], the current Ids represented by Expression 3 still flows between the drain and the source of the driving transistor TDR even after the elapse of the unitary period H[i] (after the start of the driving period PDR), thereby charging the capacitor C2. Accordingly, as shown in FIG. 5, the voltage (the electric potential VS of the source of the driving transistor TDR) across the capacitor C2 gradually increases with the voltage VGS of the driving transistor TDR maintained at the voltage VGS3 at the end point of the period h2. In addition, when the voltage across the capacitor C2 reaches the threshold voltage VTH_OLED of the light emitting element E; the current Ids flows as driving current IDR in the light emitting element E as shown in FIG. 9. Accordingly, the driving current IDR is represented by the following Expression 6.

$$IDR = 1/2 \cdot \mu \cdot W/L \cdot \mathrm{Cox} \cdot (VGS3 - VTH)^2 = 1/2 \cdot \mu \cdot W/L \cdot \mathrm{Cox} \cdot \{(VIN + VTH - \Delta V) - VTH\}^2 = 1/2 \cdot \mu \cdot W/L \cdot \mathrm{Cox} \cdot (VIN - \Delta V)^2 \quad \text{Expression 6}$$

The supply of the driving current IDR to the light emitting element E is terminated at the start point of the unitary period H[i−4] at which the control signal GB[i] reaches the active level in the next time. As can be seen from Expression 6, the driving current IDR depends on the voltage VGS3 which is set in accordance with the gradation potential VDATA[i]_k. Accordingly, the light emitting element E emits light with a brightness depending on the gradation potential VDATA[i]_k (that is, the gradation level D).

The voltage VGS3 of Expression 5 is a voltage obtained by changing the threshold voltage VTH, which is set in the compensation period PCP, in accordance with the gradation potential VDATA[i]_k. Hence, the driving current IDR does not depend on the threshold voltage VTH as represented by Expression 6. Accordingly, even when errors exist in the threshold voltages VTH of the driving transistors TDR of the pixel circuits U, the driving currents IDR are set to a target value corresponding to the gradation potential VDATA. Specifically, errors of the driving currents IDR caused by the threshold voltages VTH of the driving transistors TDR of the pixel circuits U are compensated by the first compensation operation during the compensation period PCP.

The voltage ΔV (the amount of change of the voltage VGS between the gate and the source of the driving transistor TDR caused by the second compensation operation) of Expression 6 depends on the mobility μ of the driving transistor TDR. Specifically, the voltage ΔV increases as the mobility μ of the driving transistor TDR increases. As described above, the mobility μ of the driving transistor TDR is reflected in the driving current IDR by the second compensation operation. Accordingly, it is possible to compensate the error of the driving current IDR caused by the mobility μ of the driving transistor TDR by executing the second compensation operation during the period h2.

In the above-mentioned embodiments, during the reset period PRS and the compensation period PCP, the electric supply line 28 is used as a wire for supplying the reference potential VREF to the gate of the driving transistor TDR, separately from the signal line 14 for supplying the gradation potential VDATA[i]_k to the pixel circuit U. In such a manner, it is possible to set the reset period PRS and the compensation period PCP before the start of the unitary period H[i] (the period h2). Accordingly, compared with the configuration disclosed in the Japanese Unexamined Patent Application Publication No. 2007-310311 that requires the execution of the reset operation and the first compensation operation during the selection of the scanning line 12, a time sufficient for the reset period PRS and the compensation period PCP is secured even when the unitary period H[i] is short. For example, as shown in FIG. 5, the four unitary periods H (H[i−4] to H[i−1]) are used as the reset period PRS and the compensation period PCP. As a result, it is possible to accurately set the voltage VGS across the holding capacitor C1 to the predetermined voltage VGS1 during the reset period PRS. In addition, it is also possible to accurately set the voltage VGS to the threshold voltage VTH of the driving transistor TDR during the compensation period PCP.

Figure 10:
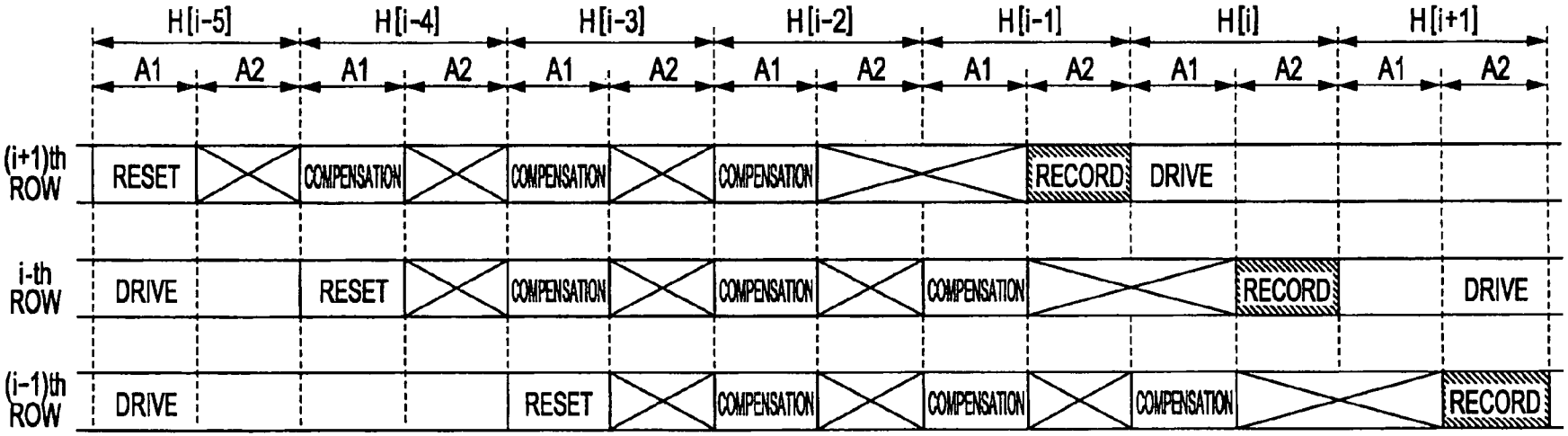
FIG. 10 is a timing chart illustrating operations of the comparative example.

Meanwhile, in order to execute the compensation operation during the plural unitary periods H when the signal line 14 is used for both functions of the supply of the reference potential VREF and the supply of gradation potential VDATA, the following exemplary method (hereinafter, it is referred to as a "comparative example") shown in FIG. 10 can be considered. Each of the plurality of unitary periods H[1] to H[m] is divided into a period A1 and a period A2, and the supplies of the gradation potentials VDATA[i]_1 to VDATA [i]_3 to the signal lines 14 and the selection of the i-th row scanning line 12 (in the embodiment, operations executed within the unitary period H[i]) are executed during the period A2 of the unitary period H[i]. In addition, the compensation operation is executed when the i-th row compensation periods PCP are set to correspond to the periods A1 of the plurality of unitary periods H (H[i−3] to H[i−1]) before the start of the unitary period H[i]. During the i-th row compensation period PCP, an electric potential of the signal line 14 is set to the reference potential VREF, and the i-th row scanning line 12 is selected (the selection switch TSL is in a conductive state). In such a manner, the reference potential VREF of the signal line 14 is supplied to the gate of the driving transistor TDR of each pixel circuit U. As a result, in the comparative example, it is possible to remove the control switch TCR and the electric supply line 28.

However, in the comparative example, during the period A1 of the unitary period H[i], the signal line 14 is used to supply the reference potential VREF to the pixel circuit U of the different row. Hence, the time (the period A2) capable of being used in the output of the gradation potential VDATA to the signal line 14 is reduced as compared with the embodiment. Accordingly, since the expensive signal line driving circuit 34 operable at an adequate high speed is needed. This causes a problem in that costs of the light emitting device 100 increase. On the other hand, by reducing the period A1, it is also possible to sufficiently secure a time length of the period A2 for outputting the gradation potential VDATA to the signal line 14. However, a considerable time (for example, several hundreds of milliseconds) is needed to make the voltage VGS of the driving transistor TDR reach the threshold voltage VTH by executing the first compensation operation. For this reason, when the period A1 of each unitary period H is reduced, it is necessary to increase the number of the periods A1 of the unitary periods H used as the compensation periods PCP. Furthermore, the number of the unitary periods H (the driving periods PDR), which can be used to supply the driving current IDR to the light emitting element E, is reduced as many as an increased number of the unitary periods H for executing the first compensation operation. This causes a problem in that the brightness of the light emitting element E is insufficient.

In the embodiment, the wires (the signal line 14 and the electric supply line 28) are individually used for the supply of the gradation potential VDATA and the supply of the reference potential VREF to each pixel circuit U. In such a manner, it is possible to set the compensation period PCP regardless of the supply of the gradation potential VDATA to the signal line 14. As a result, the following advantages are obtained. First, it is possible to reduce the speed of the operation required for the signal line driving circuit 34 as compared with the comparative example. Second, it is possible to improve insufficiency in brightness of the light emitting element E caused by the securing of the compensation period PCP as a compared with the comparative example.

B. Modified Examples

The above-mentioned embodiments may be modified in various forms. Examples of detailed aspects of the modifications based on the embodiments will be described in the following section. In addition, two or more aspects may be combined by optionally selecting those from the following examples.

1. Modified Example 1

Figure 11:
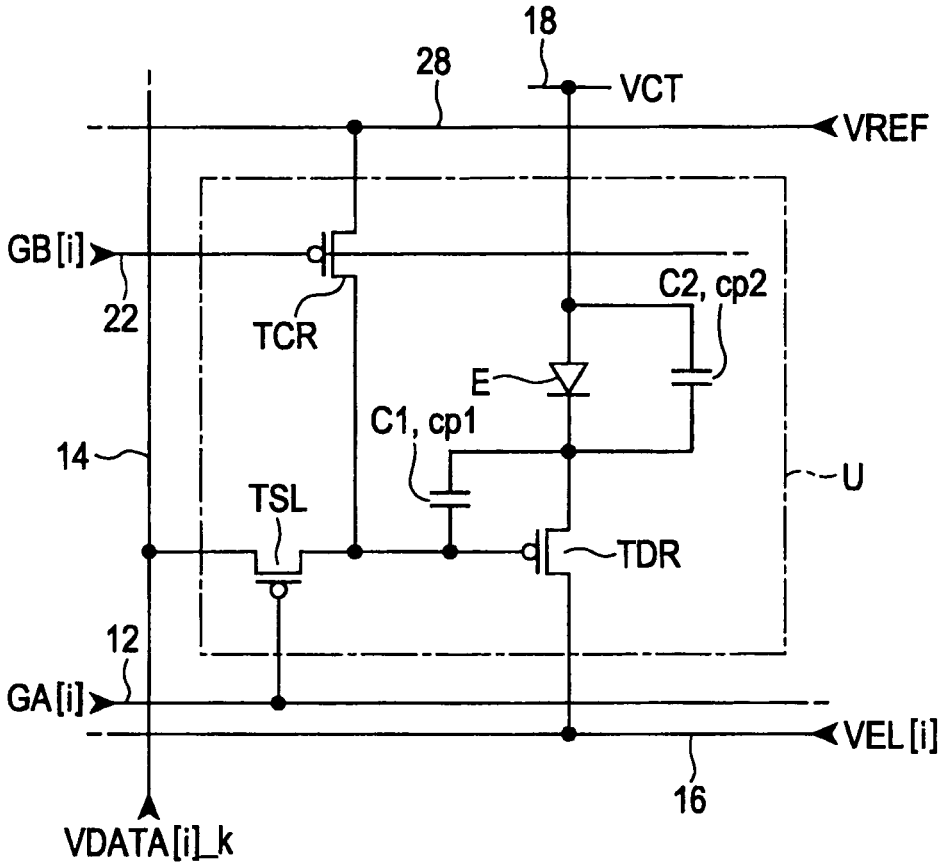
FIG. 11 is a circuit diagram illustrating a pixel circuit according to a modified example.

The conductive types of the transistors (the driving transistor TDR, the selection switch TSL, and the control switch TCR) constituting the pixel circuit U may be optional. For example, as shown in FIG. 11, it may be possible to adopt the pixel circuit U in which the driving transistor TDR and the switches (the selection switch TSL and the control switch TCR) are P-channel types. In the pixel circuit U shown in FIG. 1, the anode of the light emitting element E is connected to the electric supply line 18 (the electric potential VCT), the drain of the driving transistor TDR is connected to the electric supply line 16 (the electric potential VEL[i]), and the source thereof is connected to the cathode of the light emitting element E. Some configurations are the same as the pixel circuit U shown in FIG. 2 in that the holding capacitor C1 is interposed between the gate and the source of the driving transistor TDR, the selection switch TSL is interposed between the gate of the driving transistor TDR and the signal line 14, and the control switch TCR is interposed between the gate of the driving transistor TDR and the electric supply line 28. When the P-channel type driving transistor TDR may be used as described above, a voltage relationship (high or low) is inversed, but the basic operations are the same as those of the above examples, as compared with the case where the N-channel type driving transistor TDR is used. Therefore, the description of detailed operations is omitted herein.

2. Modified Example 2

The number of the unitary periods H used as the reset period PRS and the compensation period PCP may be optional. For example, it may be possible to adopt the configuration in which three or more unitary periods H are used as the compensation period PCP or one unitary period H is used as the compensation period PCP. Even when the compensation period PCP is the one unitary period H, it is possible to achieve a desired effect that can sufficiently secure the time for the reset operation and the first compensation operation according to the embodiment of the invention, compared with the technique disclosed in Japanese Unexamined Patent Application Publication No. 2007-310311 that requires completion of the supply of the gradation potential VDATA, the reset operation, and the first compensation operation within the one unitary period H. In addition, in the above configuration, each of the reset period PRS and the compensation period PCP is started and terminated simultaneously with the unitary period H (that is, each of the reset period PRS and the compensation period PCP is integer times the unitary period H). However, it may be possible to adopt a configuration in which each of the reset period PRS and the compensation period PCP is set regardless of the time length and the start and end points of the unitary period H.

3. Modified Example 3

The number of the signal lines 14 included in the blocks B may be optional. Further, the number of the switches SW constituting the distribution circuits MP may be changed in accordance with the number of the signal lines 14 in the blocks B. In the above-mentioned embodiments, the plurality of signal lines 14 is divided into blocks B when the array of the pixel circuits U of the three colors (red, green, and blue) is set as a unit. However, the method of dividing the plurality of signal lines 14 into the plurality of blocks B may be optional. For example, the plurality of signal lines 14 may be divided into the predetermined number which is determined regardless of the display colors of the pixel circuits U. Furthermore, the configuration in which the plurality of signal lines 14 is divided into the blocks B is not essential. For example, it may be possible to adopt a configuration in which the operations of distributing the gradation potentials VDATA to the signal lines 14 within blocks B are not executed in parallel on the plurality of blocks B but the gradation potential VDATA are time-divisionally and sequentially distributed to all the signal lines 14 in the element section 10 (that is, a configuration in which all the signal line 14 in the element section 10 is set as one block B).

4. Modified Example 4

Figure 12:
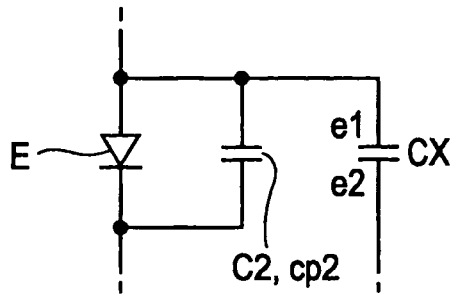
FIG. 12 is a partial circuit diagram illustrating a pixel circuit according to the modified example.

In the above-mentioned embodiments, the capacitor C2 associated with the light emitting element E is used. However, as shown in FIG. 12, it may be possible to adopt a configuration in which a capacitor CX formed separately from the light emitting element E is used together with the capacitor C2. An electrode e1 of the capacitor CX is connected to the path (the source of the driving transistor TDR) between the driving transistor TDR and the light emitting element E. An electrode e2 of the capacitor CX is connected to a wire (for example, the electric supply line 18 supplied with the electric potential VCT, or the electric supply line 28 supplied with the reference potential VREF) supplied with a predetermined electric potential. In the configuration shown in FIG. 12, the capacitance cp2 is equal to the total capacitance of the capacitor CX and the capacitor C2 of the light emitting element E. As a result, it is possible to appropriately adjust the voltage VGS2 of Expression 4 and the voltage VGS3 of Expression 5 (additionally, the driving current IDR of Expression 6) in accordance with a capacitance of the capacitor CX.

5. Modified Example 5

In the above-mentioned embodiment, the first compensation operation is executed on each pixel circuit U of the i-th row before the start of the unitary period H[i]. However for example, it may be possible to adopt a configuration in which the first compensation operation of the i-th row has been executed from a time point before the start of the unitary period H[i] to the end point of the period h1 (before the start of the period h2) of the unitary period H[i]. The above aspect is achieved by maintaining the control signal GB[i] at the active level in the range from the time point before the start of the unitary period H[i] to the end point of the period h1 of the unitary period H[i].

6. Modified Example 6

In the above-mentioned embodiment, the error of the threshold voltage VTH is compensated by the first compensation operation and the error of the mobility μ is compensated by the second compensation operation. However for example, when the error of the mobility μ does not cause a particular problem, it may be possible to adopt a configuration in which the second compensation operation is removed. During the unitary period H[i], for example, the current Ids may be cut off by controlling the switch in the path of the current Ids to be in the OFF state. In this case, the voltage VGS between the gate and the source of the driving transistor TDR is not changed from the voltage VGS2 of Expression 4 which is set in accordance with the gradation potential VDATA. Specifically, the second compensation operation is not executed on the i-th row pixel circuits U.

7. Modified Example 7

The organic EL element is just an example of the light emitting element. For example, the invention may be applied to a light emitting device having light emitting elements, such as inorganic EL elements or LED (Light Emitting Diode) elements, arranged therein similarly to the above aspects. The light emitting element according to the embodiments of the invention is a current-driving-type driven element which is driven (typically gradation (brightness) is controlled) by the supplying current.

C. Application Examples

Figure 13:
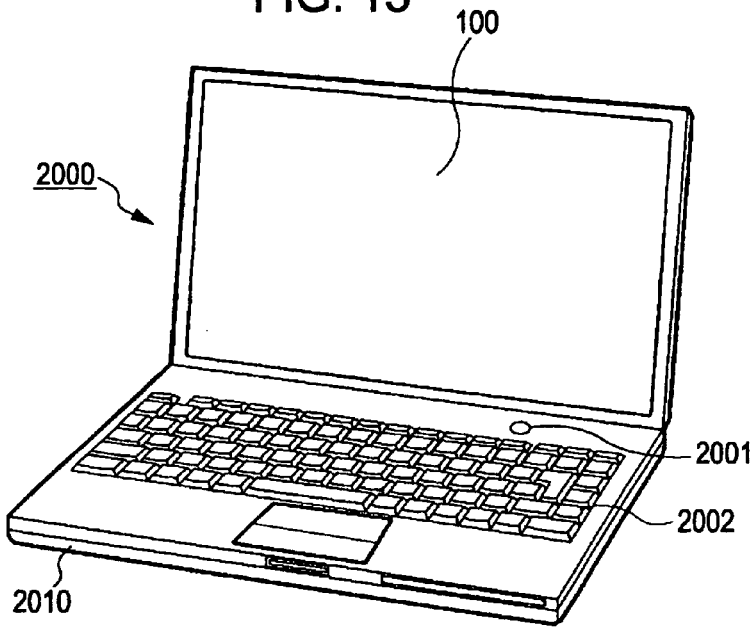
FIG. 13 is a perspective view illustrating an electronic apparatus (a personal computer).
Figure 14:
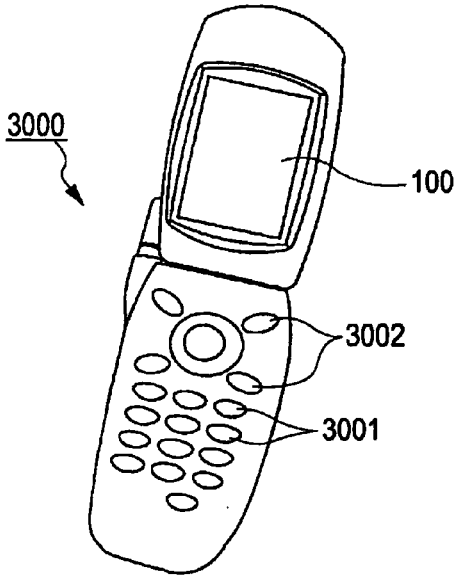
FIG. 14 is a perspective view illustrating an electronic apparatus (a mobile phone).
Figure 15:
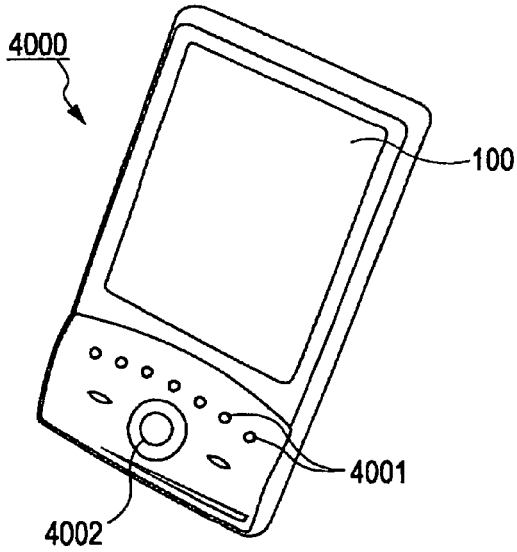
FIG. 15 is a perspective view illustrating an electronic apparatus (a portable information terminal).

Next, electronic apparatuses using the light emitting device 100 according to the above aspect will be described. FIGS. 13 to 15 show embodiments of electronic apparatuses using the light emitting device 100 as a display device.

FIG. 13 is a perspective view illustrating a configuration of a mobile type personal computer using the light emitting device 100. The personal computer 2000 includes the light emitting device 100 for displaying various images and a main body 2010 equipped with a power switch 2001 and a keyboard 2002. The light emitting device 100 uses an organic EL element as the light emitting element E, whereby it is possible to display a quite visible screen with a wide viewing angle.

FIG. 14 is a perspective view illustrating a configuration of a mobile phone using the light emitting device 100. The mobile phone 3000 includes a plurality of operation buttons 3001 and scroll buttons 3002, and the light emitting device 100 for displaying various images. By operating the scroll buttons 3002, the screen displayed on the light emitting device 100 is scrolled.

FIG. 15 is a perspective view illustrating a configuration of a portable information terminal (PDA: Personal Digital Assistants) using the light emitting device 100. The portable information terminal 4000 includes a plurality of operation buttons 4001 and a power switch 4002, and the light emitting device 100 for displaying various images. When the power switch 4002 is operated, various information such as an address book and a schedule note are displayed on the light emitting device 100.

Examples of electronic apparatuses using the light emitting device according to the embodiments of the invention include not only the apparatuses shown in FIGS. 13 to 15 but also include: a digital still camera, a television; a video camera; a car navigation system; a pager; an electronic personal organizer; an electronic paper; an electronic calculator; a word processor; a workstation; a video telephone; a POS terminal; a printer; a scanner; a copier; a video player; a device with a touch panel; and the like. A use of the light emitting device according to the embodiment of the invention is not limited to display of an image. For example, the light emitting device according to the embodiment of the invention may be used as an exposure device for forming a latent image on a photosensitive drum by performing an exposure process in an electrophotographic type image forming apparatus.

What is claimed is:

1. A method of driving a light emitting device, the light emitting device having a scanning line, a first signal line, a second signal line, a first light emitting element, a first driving transistor having a first gate, a first holding capacitor interposed between the first gate and a first path between the first light emitting element and the first driving transistor, a first selection switch through which the first signal line is electrically connected to the first gate while the first selection switch is in an ON state, a second light emitting element, a second driving transistor having a second gate, a second holding capacitor interposed between the second gate and a second path between the second light emitting element and the second driving transistor, a second selection switch through which the second signal line is electrically connected to the second gate while the second selection switch is in an ON state, and a demultiplexer, the method comprising:

executing a first compensation operation by supplying a reference potential from an electric supply line to the first gate and the second gate to make the first driving transistor and the second driving transistor in an ON state so that a first voltage of the first holding capacitor approaches asymptotically to a first threshold voltage of the first driving transistor and a second voltage of the second holding capacitor approaches asymptotically to a second threshold voltage of the second driving transistor during a first period;

supplying a first gradation potential to the first signal line by the demultiplexer during a second period;

supplying a second gradation potential to the second signal line by the demultiplexer during a third period, wherein the third period is after the second period;

supplying the first gradation potential from the first signal line to the first gate through the first selection switch and supplying the second gradation potential from the second signal line to the second gate through the second selection switch during a fourth period, wherein the fourth period is after the second period and the third period;

supplying a first driving current to the first light emitting element in accordance with the first voltage held at the first holding capacitor and supplying a second driving current to the second light emitting element in accordance with the second voltage held at the second holding capacitor after the fourth period; and executing a second compensation operation so that the first voltage of the first holding capacitor approaches asymptotically to the first threshold voltage and the second voltage of the second holding capacitor approaches asymptotically to the second threshold voltage after the fourth period.

2. The method of driving the light emitting device according to claim 1, wherein the first compensation operation is executed two or more times before the fourth period.

3. The method of driving the light emitting device according to claim 1, the first compensation operation being executed during at least part of the second period and the third period.

4. A light emitting device comprising:

a scanning line;

a first signal line;

a second signal line;

a first light emitting element;

a first driving transistor having a first gate;

a first holding capacitor interposed between the first gate and a first path between the first light emitting element and the first driving transistor;

a first selection switch through which the first signal line is electrically connected to the first gate while the first selection switch is in an ON state;

a second light emitting element;

a second driving transistor having a second gate;

a second holding capacitor interposed between the second gate and a second path between the second light emitting element and the second driving transistor;

a second selection switch through which the second signal line is electrically connected to the second gate while the second selection switch is in an ON state;

an electric supply line through which a reference potential is supplied;

a driving circuit having a demultiplexer, wherein:

the driving circuit executes a first compensation operation by supplying the reference potential from the electric supply line to the first gate and the second gate to make the first driving transistor and the second driving transistor in an ON state so that a first voltage of the first holding capacitor approaches asymptotically to a first threshold voltage of the first driving transistor and so that a second voltage of the second holding capacitor approaches asymptotically to a second threshold voltage of the second driving transistor during a first period;

the demultiplexer supplies a first gradation potential to the first signal line during a second period and the demultiplexer supplies a second gradation potential to the second signal line during a third period, wherein the third period is after the second period;

the driving circuit controlling the first selection switch and the second selection switch to be in an ON state during a fourth period, wherein the fourth period is after the second period and the third period;

the driving circuit has a signal processing circuit;

the demultiplexer has a first switch coupled between the first signal line and an output terminal of the signal processing circuit and a second switch coupled between the second signal line and the output terminal of the signal processing circuit;

the driving circuit controls the first switch to be in an ON state and controls the second switch to be in an OFF state during the second period, and the driving circuit controls the second switch to be in an ON state and controls the first switch to be in an OFF state during the third period; and the driving circuit controls the first switch and the second switch to be in an OFF state during the fourth period.

5. The light emitting device according to claim 4, further comprising:

a first control switch interposed between the electric supply line and the first gate; and a second control switch interposed between the electric supply line and the second gate, wherein the driving circuit controls the first control switch and the second control switch to be in an ON state during the first period.

6. The light emitting device according to claim 5, further comprising a control line, and wherein the first control switch and the second control switch are controlled by a control signal supplied to the control line.

7. An electronic apparatus comprising the light emitting device according to claim 5.

8. The light emitting device according to claim 6, wherein the control line intersects with the first signal line and the second signal line.

9. An electronic apparatus comprising the light emitting device according to claim 6.

10. An electronic apparatus comprising the light emitting device according to claim 8.

11. The light emitting device according to claim 4, wherein the electric supply line intersects with the first signal line and the second signal line.

12. An electronic apparatus comprising the light emitting device according to claim 11.

13. The light emitting device according to claim 4, wherein the first driving transistor and the second driving transistor are N channel type transistors.

14. An electronic apparatus comprising the light emitting device according to claim 13.

15. The light emitting device according to claim 4, wherein the first selection switch and the second selection switch are controlled by a scanning signal supplied to the scanning line.

16. An electronic apparatus comprising the light emitting device according to claim 4.

* * * * *